United States Patent [19]

Uchiyama

[11] 4,056,250

[45] Nov. 1, 1977

[54] COUPLING DEVICE FOR MOUNTING A MATERIAL HANDLING MACHINE ON A CIVIL ENGINEERING VEHICLE

[75] Inventor: Kanji Uchiyama, Sagamihara, Japan

[73] Assignee: Caterpillar Mitsubishi Ltd., Tokyo, Japan

[21] Appl. No.: 720,861

[22] Filed: Sept. 7, 1976

[30] Foreign Application Priority Data

Nov. 18, 1975 Japan ..... 50-137755

[51] Int. Cl.[2] ..... F16M 11/04

[52] U.S. Cl. ..... 248/14; 172/272; 214/131 A; 214/145 A

[58] Field of Search ..... 248/2, 14; 172/272, 172/273, 275; 214/131 A, 145 A; 85/5 CP

[56] References Cited

U.S. PATENT DOCUMENTS

| | | | |
|---|---|---|---|
| 3,887,096 | 6/1975 | Wieland | 172/272 X |
| 3,985,249 | 10/1976 | Aker et al. | 214/145 A |

*Primary Examiner*—Ramon S. Britts
*Attorney, Agent, or Firm*—James R. Bell

[57] ABSTRACT

A coupling device for mounting a material handling machine, such as a backhoe, on a civil engineering vehicle includes a first bracket assembly secured to the vehicle and a second bracket assembly secured to the machine. The first bracket assembly on the vehicle has a pair of coupling plate members, each of which has upper and lower pin-receiving concave seats that are open upwards. Either of the upper and lower pin-receiving concave seats are formed with locking slots, i.e., throat portions having a reduced width. A pair of upper and lower pins are adapted to be inserted into pin-attaching holes provided in the second bracket assembly secured to the material handling machine. The upper pins having width-reducing portions of a width slightly smaller than the width of the locking slots or throat portions continuous with either of the upper and lower pin-receiving concave seats. Because of the provision of the aforesaid upper and lower pin-receiving concave seats which are open upwards, the second bracket assembly may be simply mounted from above on the first bracket assembly, by placing the pins on the second bracket assembly in the pin-receiving concave seats provided in the first bracket, without an aligning operation of holes in one bracket with holes in another.

2 Claims, 3 Drawing Figures

COUPLING DEVICE FOR MOUNTING A MATERIAL HANDLING MACHINE ON A CIVIL ENGINEERING VEHICLE

BACKGROUND OF THE INVENTION

1. Field of the Invention

This invention relates to a device for mounting a material handling machine on a civil engineering vehicle, such as a tractor, so as to removably couple the former to the later.

2. Description of the Prior Art

In general, it is desired that a material handling machine, such as a backhoe, for use in excavating earth below ground level, be removably mounted on a civil engineering vehicle, such as a tractor. In other words, the material handling machine has to be mounted on the vehicle at a construction site, and then removed therefrom after completion of the construction work. There are many prior devices, of course, for removably mounting such a material handling machine on a civil engineering vehicle. However, the prior art attempts still suffer from many difficulties, such as alignment problems in mounting and dismounting such a machine on a vehicle, and are typically quite complex.

SUMMARY OF THE INVENTION

It is a principal object of the present invention to provide a coupling device for mounting a material handling machine on a vehicle which is simple to use and alleviates the need for aligning any pin-attaching holes in one bracket assembly with pin-attaching holes in another.

According to the present invention, there is provided a coupling device of the type described, which comprises a first bracket assembly secured to a civil engineering vehicle and includes a pair of brackets, each of which includes a base plate member and a coupling plate member, which protrudes at a right angle to said base plate member, each of said coupling plate members having an upper pin-receiving concave seat which is continuous with an upwardly opening locking slot of a predetermined width, and a lower pin-receiving concave seat having an upwardly opening slot, said coupling plate members being spaced apart in the horizontal direction; a second bracket assembly secured to said material handling machine, said second bracket assembly including a base plate member and a pair of coupling means protruding therefrom at a right angle thereto, said coupling means each being bifurcated into two pairs of coupling plate members and spaced apart from each other in the horizontal direction, said coupling plate members each having upper and lower pin-attaching holes which are positioned in corresponding relation to said upper and lower pin-receiving concave seats, respectively; a pair of upper pins having recessed surface means formed thereon, thereby providing the pins with middle portions having reduced widths which are slightly smaller than the predetermined width of said locking slots, said upper pins being formed with handles and being adapted to be inserted through said upper pin-attaching holes in said coupling plate members in said second bracket assembly and lower pins having a circular cross section throughout the entire lengths thereof and adapted to be inserted into said lower pin-attaching holes in said coupling plate members in said second bracket assembly.

According to the coupling device of the invention, a pair of upper pins having recessed or cut away portions on its opposite sides are inserted into holes in a pair of coupling plate members of the second bracket assembly of the material handling machine and the pins are turned to a given angular position which allows the aforesaid pins to enter locking slots continuous with the upper pin-receiving seats provided in coupling plate members of the first bracket assembly side. At the same time, a pair of lower pins are also inserted into the coupling plate members of the second bracket assembly. Then, the machine is mounted on the vehicle, with the upper pins and the lower pins seated on the upper and lower pin-receiving seats provided in the first bracket assembly on the vehicle, while the upper pins having the recessed portions are turned from the aforesaid angular position so as to bring the pins to their locking positions. Thus, the machine may be rigidly mounted on the vehicle without an aligning operation of any pin-attaching holes in one bracket assembly with corresponding pin-attaching holes in another bracket assembly. In other words, what is important in the mounting operation according to the present invention is that it is only necessary to rotate the upper pins to a desired position to allow the pins to enter the locking slots or openings continuous with pin-receiving seats in the first bracket assembly. In addition, the pins thus engaged are then turned from their initial angular positions to their locking positions. As a result, the two bracket assemblies can not be disengaged, thus providing a safe and positive coupling.

On the other hand, upon dismounting of the material handling machine from the vehicle, the upper pins are first turned to a given angular position which allows their recessed portions to go out through the locking slots continuous with the pin-receiving seats which permits the bracket assembly of the machine to be lifted in the vertical direction so as to be detached from the bracket assembly of the vehicle.

According to the present invention, there is no need to withdraw pins on which the weight of a machine is exerted, thus providing considerable convenience in dismounting the machine from the vehicle.

BRIEF DESCRIPTION OF THE DRAWINGS

FIG. 3 is an enlarged, exploded, perspective view of the coupling device constructed in accordance with the present invention.

DESCRIPTION OF THE PREFERRED EMBODIMENTS

Figure 1:
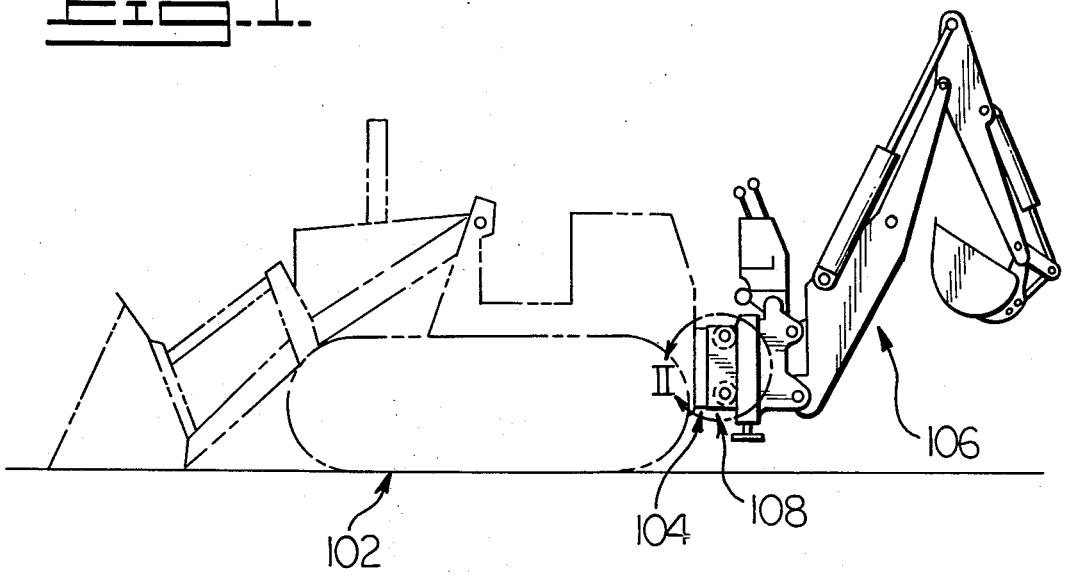
FIG. 1 is a side elevational view of a coupling device according to the present invention shown mounting a material handling machine, such as a backhoe, to a vehicle.

Referring to FIG. 1, there are shown a first bracket assembly 104 which is to be secured to a civil engineering vehicle 102, such as a tractor, and a second bracket assembly 108 which is to be secured to a material handling machine 106, such as a backhoe.

Figure 2:
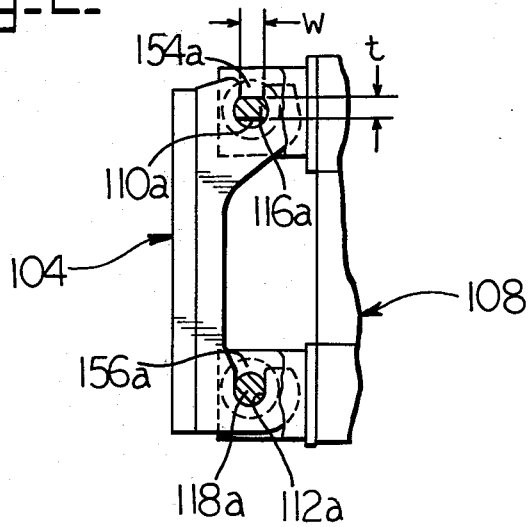
FIG. 2 is an enlarged fragmentary side view of the coupling device of FIG. 1.
Figure 5:
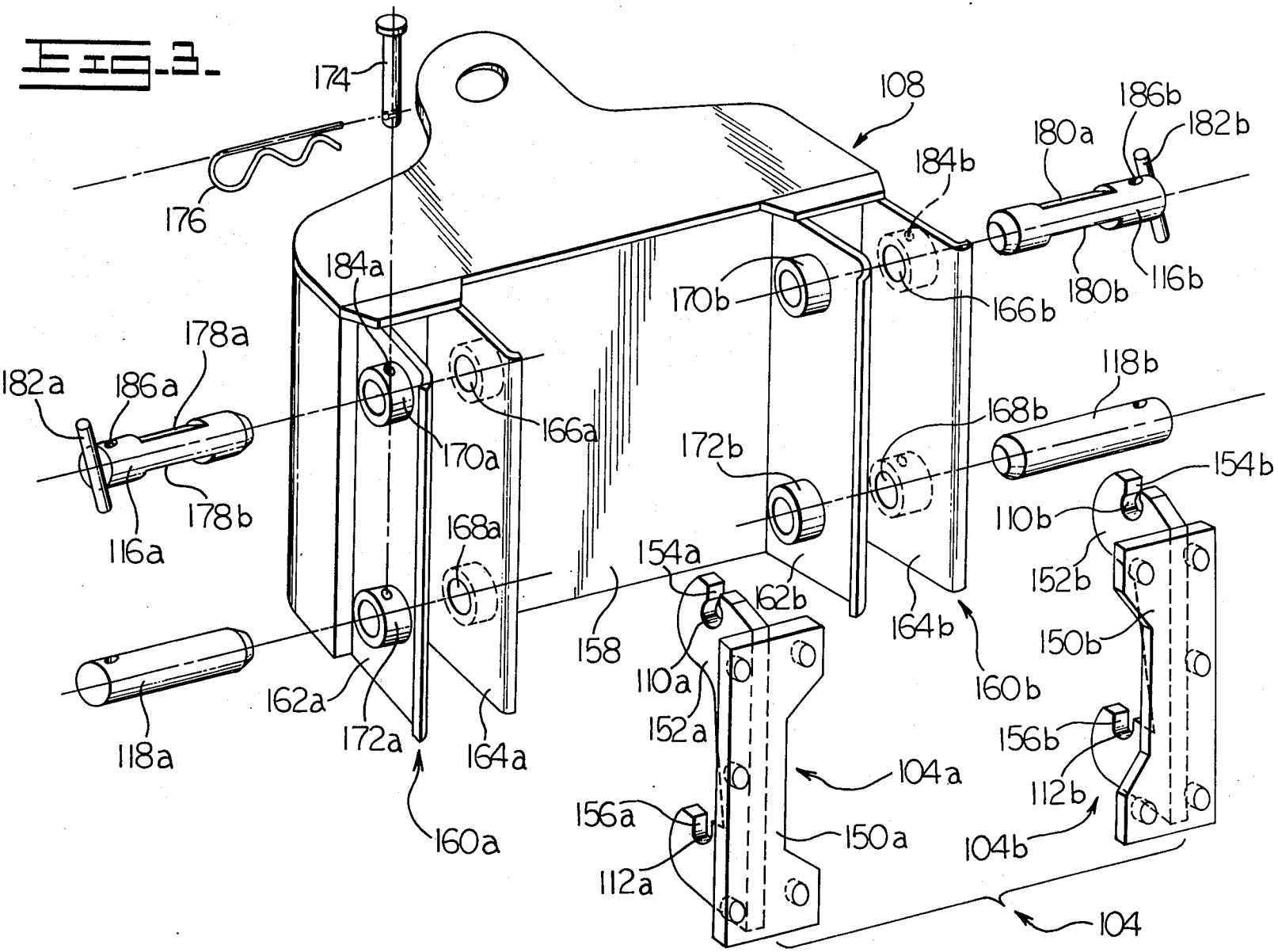

As best shown in FIGS. 2 & 3, the bracket assembly 104 includes a pair of brackets **104*a* and 104*b* which are constructed in a mirror image of each other. The brackets 104*a* and 104*b* have base plate members 150*a* and 150*b*, and coupling plate members 152*a* and 152*b* welded to the base plate members 150*a*, 150*b* at a right angle thereto. Defined in the upper portions of the coupling plate members 152***a*, 152*b* are a pair of pin-receiving concave seats 110*a*, 110*b*, and defined in the lower portions thereof are a pair of pin-receiving concave seats 112*a*, 112*b*, respectively. The diameter of the aforesaid seats are the same as those of pins which are to be received in the aforesaid seats. Stated otherwise, there are provided a pair of upper pin-receiving concave seats 110*a*, 110*b*, which are spaced a given distance one from another in the horizontal direction, and there are provided a pair of lower pin-receiving concave seats 112*a*, 112*b* which are also spaced a given distance one from another in the horizontal direction.

The upper pin-receiving concave seats 110*a*, and 110*b* are formed with locking slots or throat portions 154*a*, 154*b* which are open upwards and continuous with the seats 110*a*, 110*b*. However, these slots may be formed in either or both of the upper and lower portions of the coupling plate members 152*a*, 152*b* of brackets 104*a*, 104*b*. The widths W, FIG. 2, of the locking slots 154*a*, 154*b* are somewhat smaller than the diameter of the upper pins to be fixed to the bracket assembly 108 on the side of the material handling machine 106. This will be described in more detail later. In contrast thereto, the lower pin-receiving concave seats 112*a*, 112*b* are formed with slots 156*a*, 156*b* extending in the vertical direction, which slots have a diameter which is the same as or somewhat larger than the diameter of the lower pins to be fixed to the bracket assembly 108.

As shown in FIG. 3, the second bracket assembly 108 has a bracket body or a base plate member 158, which is suitably secured to a material handling machine, such as a backhoe 106. Secured to the surface of the base plate member 158 of the bracket assembly 108 are coupling plate means 160*a*, 160*b*, each of which is bifurcated into coupling plate members 162*a*, 162*b*, and 164*a* and 164*b* to which pins are to be attached. Each pair of bifurcated coupling plate members 162*a*, 162*b*, and 164*a*, 164*b* are positioned at a spacing larger than the width of the coupling plate members 152*a*, 152*b* of the bracket assembly 104, but in parallel relation to each other.

Defined in the coupling plate members 162*a*, 162*b*, and 164*a*, 164*b* are upper pin-attaching holes 166*a*, 166*b*, respectively, and lower pin-attaching holes 168*a*, 168*b*, respectively. In addition, it is preferable that upper pin-attaching bosses 170*a*, 170*b*, and lower pin-attaching bosses 172*a*, 172*b* are secured to the coupling plate members 162*a*, 162*b*, and 164*a*, 164*b* by welding or the like in positions corresponding to those of the pin-attaching holes 166*a*, 166*b* and 168*a*, 168*b*, respectively. Upper pins 116*a*, 116*b*, and lower pins 118*a*, 118*b* are inserted in the upper pin-attaching holes 166*a*, 166*b* and lower pin-attaching holes 168*a*, 168*b*, respectively. The upper pins 116*a*, 116*b* have recessed portions on its opposite sides, thus providing flat surface portions 178*a*, 178*b*, and 180*a*, 180*b*, respectively, which are adapted to be inserted through the slots 154*a*, 154*b* into the pin-receiving concave seats 110*a*, 110*b*, respectively. The upper pins 116*a*, 116*b* are rotatably fitted in the pin-attaching holes 166*a*, 166*b* to their given angular positions and fixedly secured in position by means of locking pins 174 and cotter pins 176 which are to be inserted into holes 184*a*, 184*b* defined in the pin-attaching boss members and holes 186*a*, 186*b* defined in the pins 116*a*, 116*b*, respectively. As best shown in FIG. 3, the width *t* of the recessed portions, which width is defined by the flat surfaces of 178*a* and 178*b* of the upper pins 116*a*, 116*b*, is slightly smaller than the width W of the locking slots 154*a*, 154*b* in the coupling plate members 152*a*, 152*b*.

Thus, the upper pins 116*a*, 116*b* may be inserted through the locking slots 154*a*, 154*b* only when the direction of the flat surfaces 178*a*, 178*b* and 180*a*, 180*b* are at a right angle to their positions shown in FIG. 2, i.e, when the flat surfaces 178*a*, 178*b* and 180*a*, 180*b* are turned parallel to the direction of the side walls of the locking slots 154*a*, 154*b*, respectively. Accordingly, when the locking or upper pins 116*a*, 116*b* are in the position shown in FIG. 2, they are prevented from escaping from their respective pin seats. It will be appreciated, however, that the recessed portions of the upper pins 116*a*, 116*b* which are to be placed through the locking slots 154*a*, 154*b* may be of any shape, so long as the aforesaid portions may be admitted through the locking slots only in a given angular position and can not be disengaged in any other position. For instance, the cross section of the aforesaid portions may be of a semicircular shape. It is preferable, however, that the head portions of the upper pins 116*a*, 116*b* be formed with suitable turning means. As shown in FIG. 3, handle members 182*a*, 182*b* are provided as the aforesaid turning means for the head portions of the upper pins 116*a*, 116*b*. In operation, the handle members 182*a*, 182*b* may be turned by tapping same with a hammer. In addition, as an alternative, the turning means may be provided in the form of hexagonal heads which may be turned by means of a wrench or the like. In contrast thereto, the lower pins 118*a*, 118*b* may be of a circular shape in cross section.

With the embodiment shown, a pair of upper pins and a pair of lower pins 116*a*, 116*b*, 118*a*, 118*b*, respectively, are relatively short in length. Alternatively, such a pair of pins may be replaced by a single elongated pin, which extends over the entire width of the bracket assembly 108 or base plate member 158. In this case, however, the coupling plate members 164*a*, 164*b* may be omitted.

Upon mounting of a material handling machine 106 on a vehicle 102, the upper pins 116*a*, 116*b* and lower pins 118*a*, 118*b* of a second bracket assembly 108 are fitted into the upper pin-attaching holes 166*a*, 166*b*, and lower pin-attaching holes 168*a*, 168*b*, respectively, beforehand. Then, the upper pins 116*a*, 116*b* are turned to a given angular position which allows the upper pins 116*a*, 116*b* to be placed through the locking slots 154*a*, 154*b* in the pin-receiving seats 110*a*, 110*b*, respectively. Then, by initially raising the material handling machine 106, the vehicle 102 may be moved so that the pin seats are brought into underlying relationship with their respective pins. In this respect, in the case of a backhoe which is equipped with a stabilizer, the material handling machine may be moved up and down by means of such stabilizer. After this is accomplished, the upper pins 116*a*, 116*b* are placed through the locking slots 154*a*, 154*b* in the respective pin-receiving seats 110*a*, 110*b*, while the lower pins 118*a*, 118*b* are placed through the slots 156*a*, 156*b* in the respective pin-receiving seats 112*a*, 112*b* simply by lowering the machine. In this case, the handle members 182*a*, 182*b* secured to the head portions of the upper pins 116*a*, 116*b* are tapped with a hammer so as to bring same to a given transverse angular position as shown in FIG. 2 so as to lock the bracket assemblies 104 and 108 together. Thereafter, locking pins 174 and cotter pins 176 are inserted into corresponding holes for rigidly securing the upper pins 116*a*, 116*b* in position. It is not necessary that the lower pins 118*a*, 118*b* be locked with locking pins and cotter pins. Thus, the bracket assembly 104 on the side of a vehicle may be positively and easily coupled to the bracket assembly 108 on the side of the material handling machine. In other words, the material handling machine 106 may be positively and easily mounted on the vehicle 102.

Upon dismounting of the material handling machine 106 from the vehicle 102, the cotter pins 176 and locking pins 174 are first withdrawn so as to permit the turning of the upper pins 116*a,* 116*b.* Then, the upper pins 116*a,* 116*b* are turned to an angular position which allows the pins 116*a,* 116*b* to go out through the locking slots 154*a,* 154*b.* Then, the upper pins 116*a,* 116*b* are withdrawn upwardly from the upper pin-receiving seats 110*a,* 110*b* through the slots 154*a,* 154*b,* while the lower pins 118*a,* 118*b* are withdrawn from the lower pin-receiving seats 118*a,* 118*b* through the slots 156*a,* 156*b,* respectively. In this manner, the first bracket assembly 104 on the vehicle may be disengaged from the second bracket assembly 108 on the material handling machine.

While the description has been given of the preferred embodiment of the invention, various modifications and alterations may be inferred by those skilled in the art without departing the spirit of the present invention. For instance, the lower pin-receiving seats may be formed with locking slots, while the upper pin-receiving seats may be formed with ordinary slots having a width which is a slightly larger width than the width of pins having flat or recessed portions. Still alternatively, both of the upper and lower pin-receiving seats may be formed with locking slots, and the upper and lower pins may be formed with flat or recessed surfaces which may be fitted through the aforesaid locking slots.

As is apparent from the foregoing description of the mounting device according to the present invention, it is not necessary to bring the pin-attaching seats of the first bracket assembly into registry with the pin-receiving holes of the second bracket assembly to allow the insertion of pins. Thus, the mounting operation of the material handling machine on the vehicle may be conducted with a high operational efficiency.

While the present invention has been described herein with reference to certain exemplary embodiment thereof, it should be understood that various changes, modifications and alterations may be effected without departing from the spirit and the scope of the present invention, as defined in the appended claims.

What is claimed is:

1. A coupling device for mounting a material handling machine on a civil engineering vehicle comprising:

a first bracket assembly secured to said vehicle and including a pair of brackets, each having a base plate member and a coupling plate member which protrudes at a right angle to said base plate member, each of said coupling plate members having an upper pin-receiving concave seat with an upwardly opening locking first slot of a first predetermined width continuous therewith, and a lower pin-receiving concave seat with an upwardly opening second slot of a second predetermined width continuous therewith, said second width being relatively greater than said first width, and said coupling plate members being spaced apart in a horizontal direction;

a second bracket assembly secured to said material handling machine, said bracket assembly including a base plate member and pair of coupling means which protrude at a right angle from the base plate member, said coupling means each being bifurcated into two parts of coupling plate members which are disposed in horizontally spaced relation to each other, said coupling plate members each having upper and lower pin-attaching holes positioned in corresponding relation to said upper and lower pin-receiving concave seats, respectively, of said first bracket assembly;

a pair of upper pins having recessed surface means formed thereon, thereby providing the pins with middle portions having reduced widths which are slightly smaller than the predetermined width of said locking slots, said upper pins being formed with handles and being adapted to be inserted through said upper pin-attaching holes in said coupling plate members of said second bracket assembly; and lower pins having circular cross sections throughout the entire lengths thereof and adapted to be inserted into said lower pin-attaching holes in said coupling plate members of said second bracket assembly.

2. A coupling device for mounting a material handling machine to a civil engineering vehicle comprising:

a first bracket assembly carried by said vehicle and including a pair of upright coupling plate members disposed in a horizontally spaced relation to each other, each coupling plate member having concave upper and lower pin-receiving seats provided therein, with each of said upper seats having an upwardly opening locking first slot continuous therewith and with each of said lower seats having an upwardly opening second slot continuous therewith, said first slot having a first predetermined width and said second slot having a second width relatively greater than said first width; and a second bracket assembly carried by said material handling machine and including upper and lower pin means disposed in corresponding relation to said upper and lower pin-receiving seats, respectively, of the first bracket assembly for supporting receipt therewithin, said upper pin means being pivotally mounted and including recess means for providing the pin means with the width in one angular direction which is less than said predetermined width of said locking slot to permit the insertion of said upper pin means therethrough when the pin means is rotated to one angular position and to prevent the escape thereof when the pin is rotated to another angular position.

* * * * *

UNITED STATES PATENT AND TRADEMARK OFFICE

CERTIFICATE OF CORRECTION

PATENT NO. : 4,056,250

DATED : November 1, 1977

INVENTOR(S) : KANJI UCHIYAMA

It is certified that error appears in the above-identified patent and that said Letters Patent are hereby corrected as shown below:

Claim 1 - Column 6, line 11 - change "parts" to -- pairs --.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*